US010923823B2

(12) United States Patent
Hwang et al.

(10) Patent No.: US 10,923,823 B2
(45) Date of Patent: Feb. 16, 2021

(54) PATCH ANTENNA

(71) Applicants: AMOTECH CO., LTD., Incheon (KR); WINNERCOM CO., LTD., Gyeongsangnam-do (KR)

(72) Inventors: Chui Hwang, Incheon (KR); In-Jo Jeong, Incheon (KR); Sang-O Kim, Incheon (KR); Hyun-Woo Oh, Seongnam-si (KR); Dong-Hwan Koh, Seoul (KR); Won-Hee Lee, Incheon (KR); Tae-Byung Park, Anyang-si (KR); Gi-Cho Kang, Anyang-si (KR); Keun-Ho Baek, Hanam-si (KR)

(73) Assignees: AMOTECH CO., LTD., Incheon (KR); WINNERCOM CO., LTD., Gimhae-si (KR)

( * ) Notice: Subject to any disclaimer, the term of this patent is extended or adjusted under 35 U.S.C. 154(b) by 159 days.

(21) Appl. No.: 16/311,092

(22) PCT Filed: Jun. 2, 2017

(86) PCT No.: PCT/KR2017/005760
§ 371 (c)(1),
(2) Date: Dec. 18, 2018

(87) PCT Pub. No.: WO2018/004136
PCT Pub. Date: Jan. 4, 2018

(65) Prior Publication Data

US 2020/0313298 A1 Oct. 1, 2020

(30) Foreign Application Priority Data

Jun. 29, 2016 (KR) ..... 10-2016-0081829

(51) Int. Cl.
*H01Q 9/04* (2006.01)

(52) U.S. Cl.
CPC ..... *H01Q 9/0407* (2013.01); *H01Q 9/0414* (2013.01)

(58) Field of Classification Search
CPC .. H01Q 9/0407; H01Q 9/0414; H01Q 9/0471; H01Q 9/0464; H01Q 9/0428;
(Continued)

(56) References Cited

U.S. PATENT DOCUMENTS 5,633,645 A * 5/1997 Day ..... H01Q 9/0457 343/700 MS
6,639,556 B2 * 10/2003 Baba ..... H01Q 9/0407 343/700 MS
(Continued)

FOREIGN PATENT DOCUMENTS

JP 2016-5178 A 1/2016
KR 2010-0083550 A 7/2010
(Continued)

*Primary Examiner* — Awat M Salih
(74) *Attorney, Agent, or Firm* — CL Intellectual LLC

(57) ABSTRACT

Disclosed is a patch antenna, which is formed so that the upper surface of a dielectric layer has a wider area than the lower surface thereof and is mounted on a printed circuit board to form an air gap, thus maximizing antenna performance while implementing lightweight. The disclosed patch antenna includes a dielectric layer, a radiation patch formed on the upper surface of the dielectric layer, and a lower patch formed on the lower surface of the dielectric layer; and the dielectric layer is formed so that an area of the upper surface is wider than an area of the lower surface to form an air gap between the printed circuit board and the dielectric layer.

10 Claims, 8 Drawing Sheets

(58) Field of Classification Search
CPC ..... H01Q 9/005; H01Q 9/065; H01Q 19/005; H01Q 21/065
See application file for complete search history.

(56) References Cited

U.S. PATENT DOCUMENTS

| | | | | |
|---|---|---|---|---|
| 2003/0214443 | A1* | 11/2003 | Bauregger ..... | H01Q 3/247 343/700 MS |
| 2008/0204324 | A1 | 8/2008 | Okamura et al. | |
| 2016/0261047 | A1* | 9/2016 | Wallace ..... | H01Q 9/0414 |

FOREIGN PATENT DOCUMENTS

| | | | |
|---|---|---|---|
| KR | 2011-0104844 | A | 9/2011 |
| KR | 2014-0095131 | A | 8/2014 |

* cited by examiner

[FIG. 1]
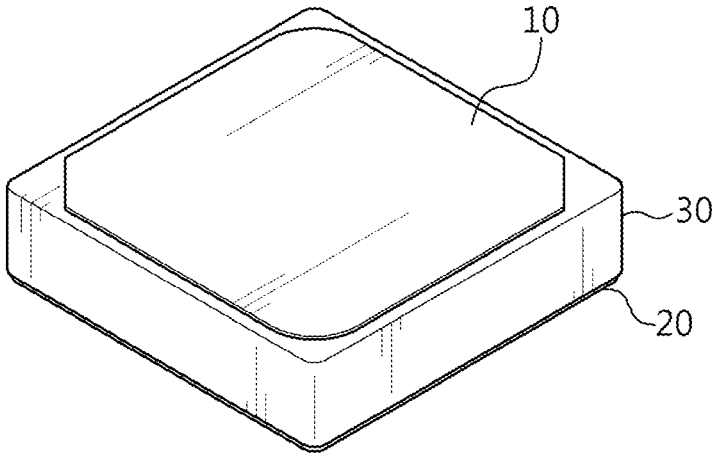

[FIG. 2]
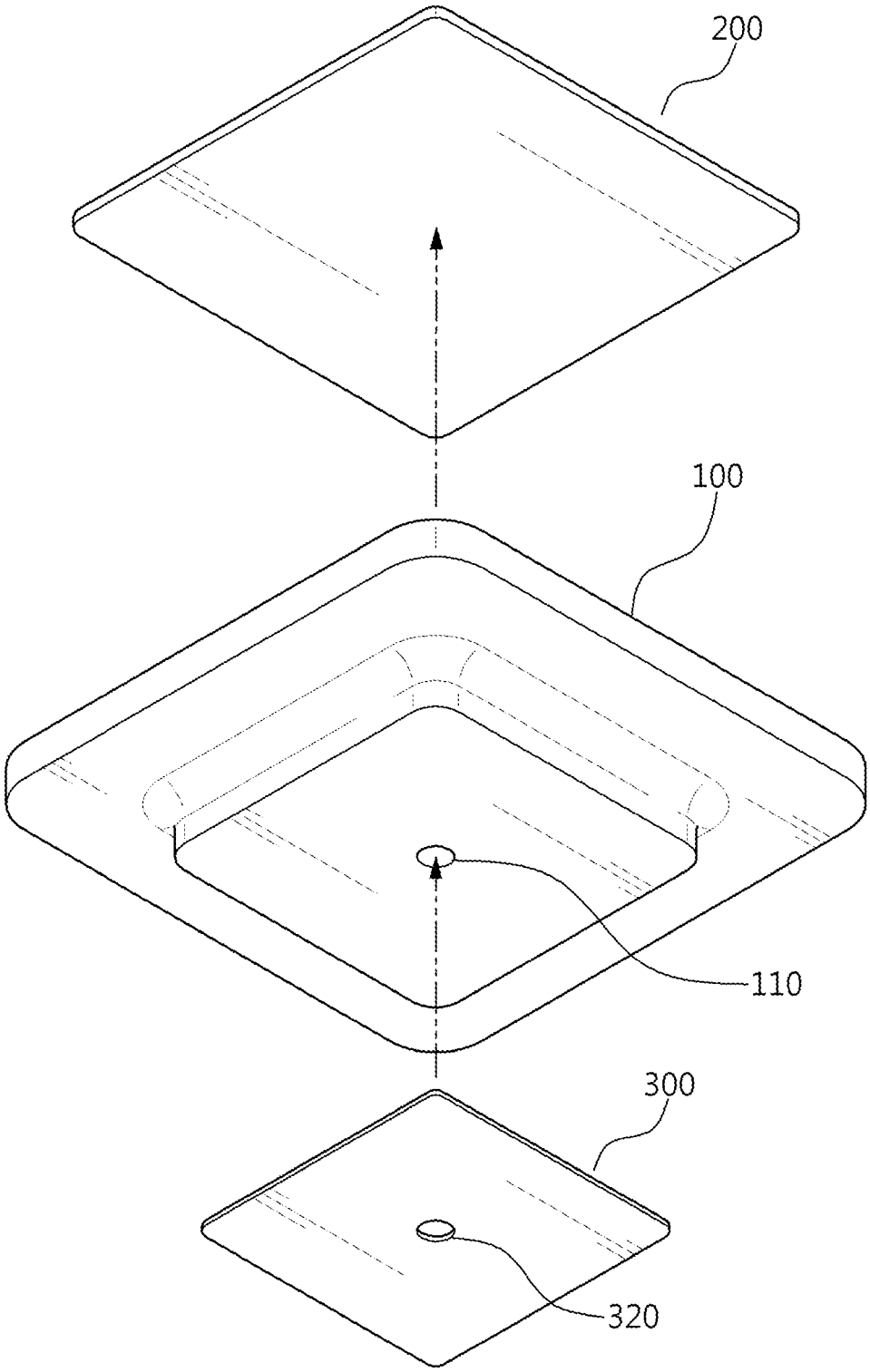

[FIG. 3]
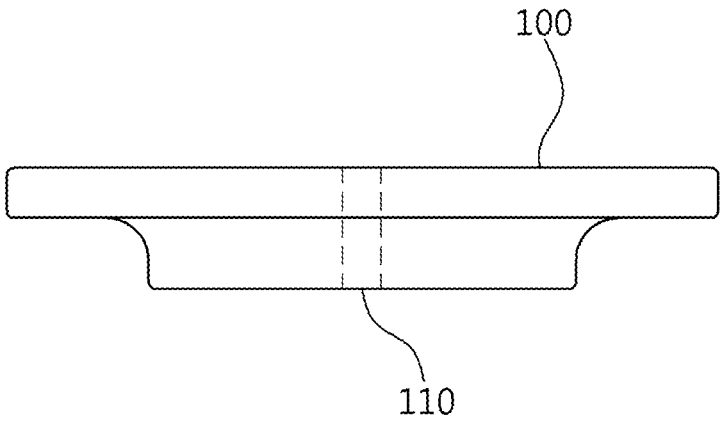
[FIG. 4]
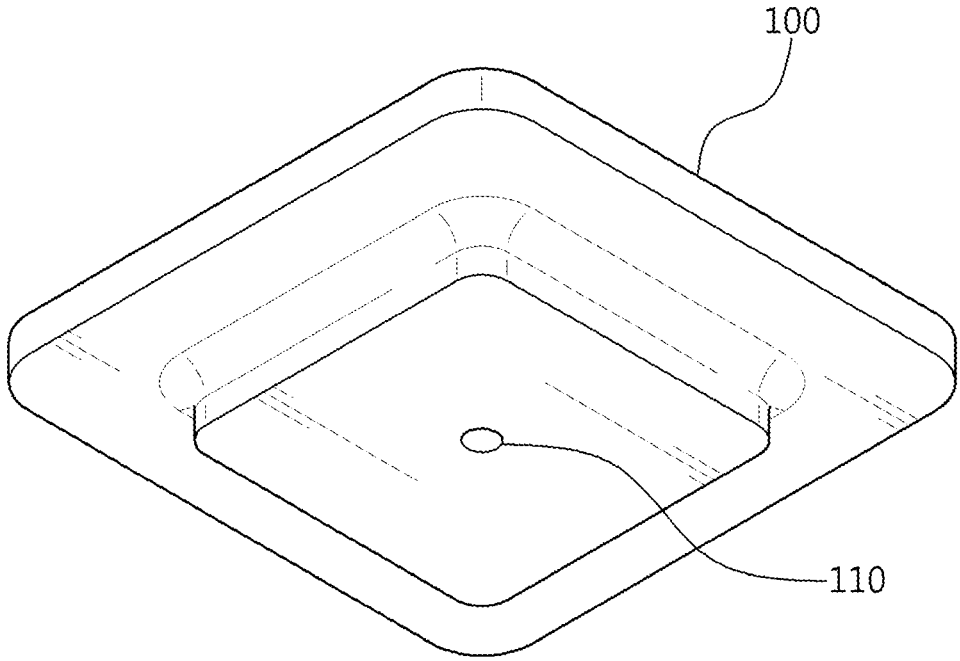

[FIG. 5]
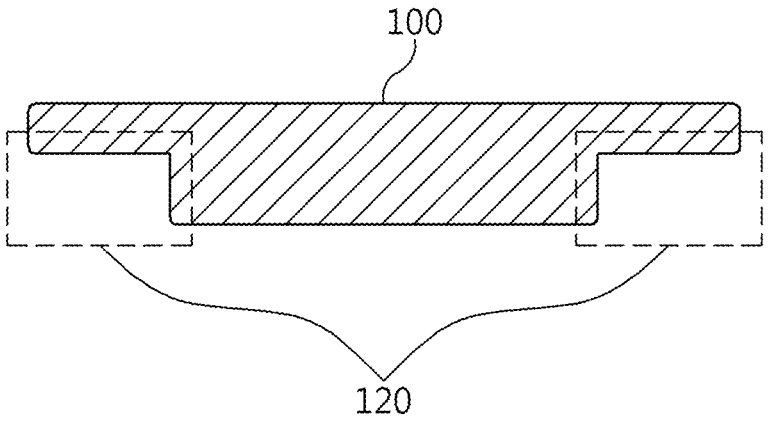
[FIG. 6]
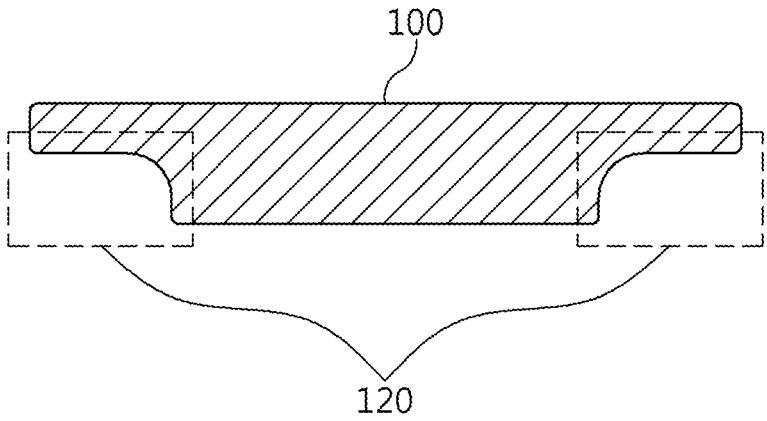
[FIG. 7]
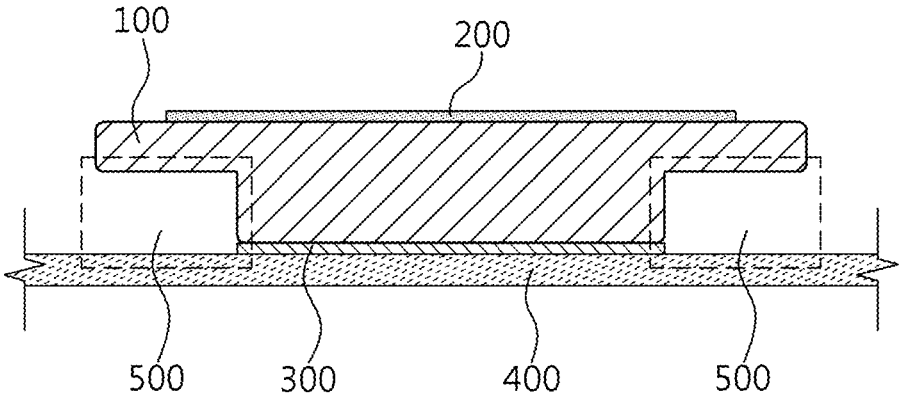

[FIG. 8]
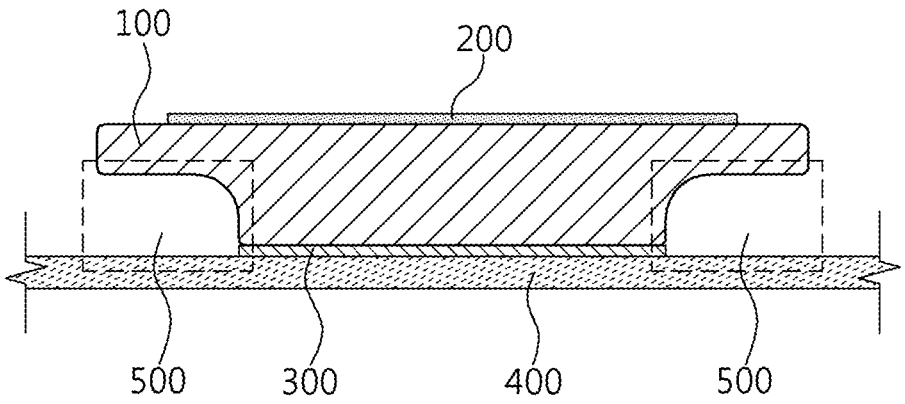
[FIG. 9]
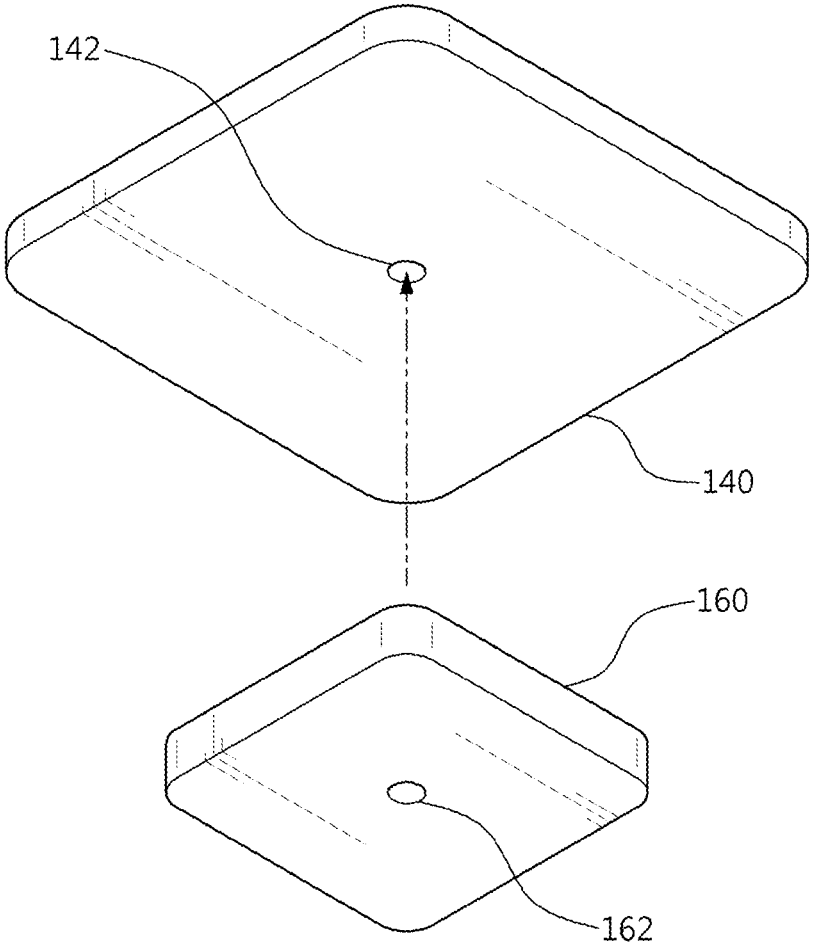

[FIG. 10]
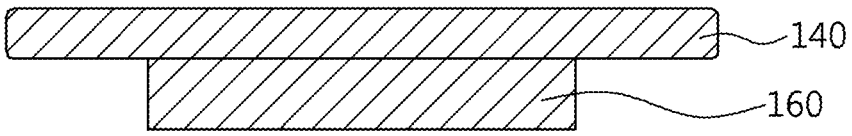
[FIG. 11]
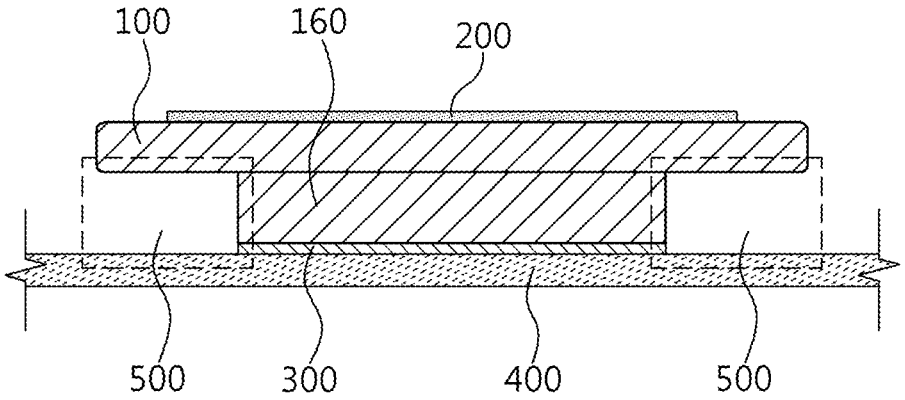

[FIG. 12]

| Pol. | Angle | Frequency[MHz] | | | | | | | | | |
|---|---|---|---|---|---|---|---|---|---|---|---|
| | | 2320 | | 2326 | | 2332 | | 2338 | | 2345 | |
| | | CONVENTION | PRESENT DISCLOSURE | CONVENTION | PRESENT DISCLOSURE | CONVENTION | PRESENT DISCLOSURE | CONVENTION | PRESENT DISCLOSURE | 종래 | PRESENT DISCLOSURE |
| LHCP AVERAGE GAIN | 0 | 5.16 | 6.23 | 5.15 | 6.19 | 5.16 | 6.20 | 4.92 | 5.98 | 4.74 | 5.77 |
| | 10 | 5.03 | 6.10 | 5.02 | 6.10 | 4.99 | 6.02 | 4.78 | 5.79 | 4.57 | 5.56 |
| | 20 | 4.63 | 5.55 | 4.62 | 5.59 | 4.59 | 5.53 | 4.35 | 5.28 | 4.14 | 5.02 |
| | 30 | 3.87 | 4.68 | 3.86 | 4.69 | 3.85 | 4.63 | 3.62 | 4.42 | 3.38 | 4.15 |
| | 40 | 2.93 | 3.49 | 2.96 | 3.53 | 2.99 | 3.54 | 2.77 | 3.30 | 2.56 | 3.07 |
| | 50 | 1.78 | 2.19 | 1.76 | 2.17 | 1.75 | 2.14 | 1.53 | 1.86 | 1.27 | 1.60 |
| | 60 | 0.55 | 0.63 | 0.54 | 0.63 | 0.57 | 0.65 | 0.39 | 0.47 | 0.15 | 0.20 |
| | 70 | -1.05 | -0.84 | -1.00 | -0.83 | -1.07 | -0.82 | -1.34 | -1.10 | -1.65 | -1.37 |
| HP AVERAGE GAIN | 80 | -6.67 | -4.56 | -6.67 | -4.61 | -6.61 | -4.56 | -6.97 | -4.84 | -7.22 | -4.99 |
| | 90 | -8.28 | -5.54 | -8.17 | -5.61 | -8.37 | -5.64 | -8.39 | -5.85 | -8.71 | -6.07 |

[FIG. 13]
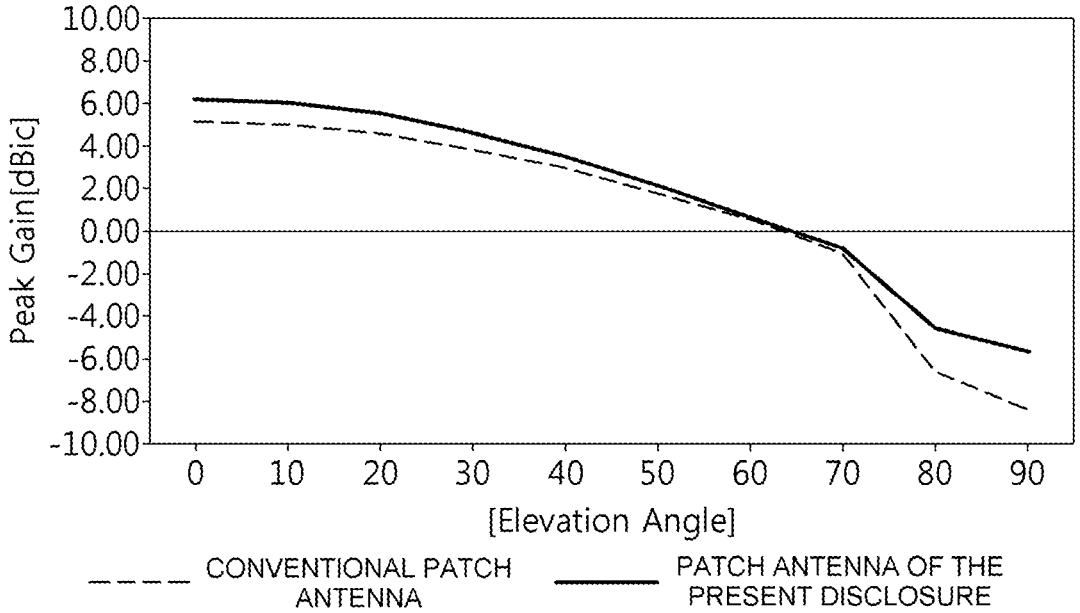

PATCH ANTENNA

CROSS-REFERENCE TO RELATED APPLICATIONS

This application is a National Stage of International patent application PCT/KR2017/005760, filed on Jun. 2, 2017, which claims priority to foreign Korean patent application No. 10-2016-0081829 filed on Jun. 29, 2016, the disclosures of which are incorporated by reference in their entirety.

FIELD OF THE INVENTION

The present disclosure relates to a patch antenna, and more particularly, to a patch antenna, which receives a signal in a frequency band of a GPS, a GNSS, SDARS, etc.

BACKGROUND

Generally, a patch antenna is installed in a vehicle, a drone, an information communication terminal, etc. to transmit and receive a signal in a frequency hand of a Global Positioning System (GPS), a Global Navigation Satellite System (GNSS), Satellite Digital Audio Radio Services (SDARS), etc.

Referring to FIG. 1, a conventional patch antenna is composed of a dielectric layer 30 formed to have a predetermined thickness, an upper patch 10 in a planar shape that is stacked on one surface (upper surface) of the dielectric layer 30 and serves as an antenna, and a lower patch 20 stacked on the other surface (lower surface) of the dielectric layer 30.

Herein, it is also referred to as a ceramic patch antenna because the dielectric layer 30 mainly uses a ceramic, which has good characteristics such as high permittivity and low thermal expansion coefficient and is mainly used for parts for a high frequency.

The shapes of the upper patch 10 and the lower patch 20 are formed in various shapes such as a square shape, a circular shape, an elliptical shape, a triangular shape, and a ring shape, and the square shape or the circular shape is mainly used therefor. In this time, the upper patch 10 and the lower patch 20 are formed of a conductive material having a high conductivity with the ceramic dielectric layer 30. The structures of the upper patch 10 and the lower patch 20 include a multilayer, a bulk type, etc.

In recent years, lightweight of a patch antenna is required according to the lightweight trends of a vehicle and a drone, such that the patch antenna is being developed in which a dielectric layer is made of a material having a high permittivity.

However, there is a problem in that when a dielectric layer is made of a material having a high permittivity, a patch antenna can become smaller in size and lightweight, but the antenna characteristic (e.g., gain) is reduced.

SUMMARY OF THE INVENTION

The present disclosure is intended to solve the above problem, and an object of the present disclosure is to provide a patch antenna, which is formed so that the upper surface of a dielectric layer has a wider area than the lower surface thereof and is mounted on a printed circuit board to form an air gap therein, thus maximizing antenna performance while implementing lightweight.

In order to achieve the object, a patch antenna according to an embodiment of the present disclosure is a patch antenna mounted on a board, includes a dielectric layer; a radiation patch formed on the upper surface of the dielectric layer; and a lower patch formed on the lower surface of the dielectric layer, and the dielectric layer is formed so that an area of the upper surface is wider than an area of the lower surface.

In this time, the lower surface of the dielectric layer can face the board when the patch antenna is mounted on the board, and the lower patch can be formed on the entire lower surface of the dielectric layer.

A patch antenna according to an embodiment of the present disclosure can further include an air gap formed in a region between the dielectric layer and the board. In this time, the air gap can be formed in a shape surrounding the surroundings of the lower patch.

Meanwhile, the dielectric layer can have a stepped portion formed on the outer circumference of the lower surface thereof, and an air gap can be formed in a region interposed between the board and the stepped portion. In this time, a cross section of the air gap can be formed in a square shape.

In addition, the dielectric layer can include an upper dielectric layer having the radiation patch formed on the upper surface thereof; and a lower dielectric layer located on the lower portion of the upper dielectric layer, and having the lower patch formed on the lower surface thereof, and the upper dielectric layer can be formed to have a wider area than the lower dielectric layer. In this time, the upper dielectric layer can have a part of the lower surface exposed toward the board, an air gap can be formed in a region interposed between the lower surface of the upper dielectric layer and the outer circumference of the lower dielectric layer and the board. Herein, the air gap can be formed in a ring shape having a cross section of a square shape.

In a patch antenna according to an embodiment of the present disclosure, the upper dielectric layer and the lower dielectric layer can be integrally formed as well.

According to the present disclosure, it is possible for the patch antenna to form the air gap between the dielectric layer and the printed circuit board, thus implementing lightweight while maximizing antenna performance. That is, the air gap has low permittivity and loss, such that it is possible for the patch antenna to enhance antenna performance, and to reduce the volume of the dielectric layer, thus implementing lightweight.

In addition, it is possible, for the patch antenna to increase the power density in the radio wave reception region as compared with the conventional patch antenna as a gain increases, thus improving a reception rate.

In addition, it is possible for the patch antenna to form the air gap that is lighter than the materials used as the dielectric layer, thus reducing the weight to implement lightweight.

BRIEF DESCRIPTION OF THE DRAWINGS

FIG. 1 is a diagram for explaining a conventional patch antenna.

FIG. 2 is a diagram for explaining a patch antenna according to an embodiment of the present disclosure.

FIGS. 3 to 11 are diagrams for explaining a dielectric layer in FIG. 2.

FIGS. 12 and 13 are diagrams for explaining the antenna characteristic of the patch antenna according to an embodiment of the present disclosure.

DETAILED DESCRIPTION

Hereinafter, the most preferred embodiment of the present disclosure will be described with reference to the accompanying drawings so that those skilled in the art to which the present disclosure pertains can easily practice the technical spirit of the present disclosure. First, in adding reference numerals to the components in each drawing, it is to be noted that the same components are denoted by the same reference numerals even though they are illustrated in different drawings. In addition, in the following description of the present disclosure, a detailed description of known configurations or functions will be omitted when it is determined to obscure the subject matter of the present disclosure.

Referring to FIG. 2, a patch antenna according to an embodiment of the present disclosure is configured to include a dielectric layer 100, a radiation patch 200 bonded to the upper surface of the dielectric layer 100, and a lower patch 300 bonded to the lower surface of the dielectric layer 100.

The dielectric layer 100 is made of a dielectric material having permittivity or a magnetic material. That is, the dielectric layer 100 is formed of a dielectric board composed of a ceramic having the characteristics such as a high permittivity and a low thermal expansion coefficient, or a magnetic board composed of a magnetic material such as ferrite. In this time, the dielectric layer 100 can be formed with a feed hole 110 into which a feed pin for the feed of the radiation patch 200 is inserted.

When the patch antenna is mounted on a printed circuit board, the dielectric layer 100 is mounted so that the lower surface thereof faces the printed circuit board.

Referring to FIGS. 3 and 4, the dielectric layer 100 is formed so that the area of the upper surface on which the radiation patch 200 is stacked is greater than the area of the lower surface on which the lower patch 300 is stacked. In this time, the dielectric layer 100 is formed so that a ratio of the area of the upper surface and the area of the lower surface keeps a setting ratio range. Herein, in the dielectric layer 100, the area of the upper surface and the area of the lower surface are formed so that the ratio of the area of the lower surface to the area of the upper surface is kept equal to or greater than a minimum setting ratio and is kept equal to or smaller than a maximum setting ratio.

For example, in the dielectric layer 100, in a case that the ratio of the area of the upper surface and the area of the lower surface is set to about 30% for the minimum setting ratio and about 80% or less for the maximum setting ratio, when the area of the lower surface is smaller than 30% of the area of the upper surface, it is possible to enhance lightweight efficiency but to reduce antenna performance, and when the area of the lower surface exceeds 80% of the area of the upper surface, it is possible to enhance antenna performance but to reduce lightweight efficiency.

Therefore, in the dielectric layer 100 the area of the upper surface and the area of the lower surface are set so that the ratio of the area of the upper surface and the area of the lower surface is kept within a range of about 30% or more to 80% or less.

Referring to FIGS. 5 and 6, the dielectric layer 100 is formed so that the area of the upper surface is greater than the area of the lower surface, such that a stepped portion 120 is formed on the outer circumference of the lower surface. In this time, the stepped portion 120 can be formed at a right angle (see FIG. 5), or can be formed in a curved shape (see FIG. 6) with respect to a cross section vertically cutting the dielectric layer 100.

The patch antenna is mounted on a printed circuit board 400, such that the dielectric layer 100 forms an air gap 500 in the stepped portion 120. That is, in the dielectric layer 100, the patch antenna is mounted on the printed circuit board 400, such that the air gap 500 is interposed between the stepped portion 120 and the printed circuit board 400.

The air gap 500 is formed along the outer circumference of the stepped portion 120 and is formed in a ring shape having a cross section in a predetermined shape. The air gap 500 can have cross sections in various shapes according to the shape of the stepped portion 120. In this time, the air gap 500 can be formed along the outer circumference of the stepped portion 120, such that it can be formed in a shape surrounding the surroundings (outer circumference) of the lower patch 300.

For example, as illustrated in FIG. 7, the air gap 500 is formed to have a cross section in a square shape when the stepped portion 120 is formed at a right angle. As illustrated in FIG. 8, the air gap 500 is formed to have a cross-section in a square shape having one side edge rounded when the stepped portion 120 is formed in a curved shape.

As described above, the air gap 500 is interposed between the dielectric layer 100 and the printed circuit board 400, such that the patch antenna can implement lightweight while maximizing antenna performance. That is, the air gap 500 has lower permittivity (about 1.03) and loss (i.e., Loss Tangent=0) than the dielectric layer 100, such that the patch antenna can enhance antenna performance a gain), and can reduce the volume of the dielectric layer 100, thus implementing lightweight.

Referring to FIGS. 9 and 10, the dielectric layer 100 can be also configured to include an upper dielectric layer 140 and a lower dielectric layer 160.

The upper dielectric layer 140 has the radiation patch 200 bonded to the upper surface thereof. The upper dielectric layer 140 is formed in various shapes such as a square shape, a circular shape, and a square shape having at least one edge rounded. The upper dielectric layer 140 is formed to have a first area wider than the lower dielectric layer 160. In this time, the upper dielectric layer 140 can be formed with a feed hole 142 into which a feed pin for the feed of the radiation patch 200 is inserted.

The upper dielectric layer 140 has the lower dielectric layer 160 bonded to the lower surface thereof, such that a part of the lower surface is exposed toward the printed circuit board 400 on which the patch antenna is mounted. That is, the upper dielectric layer 140 has the lower dielectric layer 160, which has a relatively narrow area, bonded, such that a part of the lower surface is exposed.

In this time, as illustrated in FIG. 11, the lower surface of the upper dielectric layer 140 is exposed, such that the air gap 500 is interposed between a part of the lower surface of the upper dielectric layer 140 and the outer circumference of the lower dielectric layer 160 and the printed circuit board 400 (i.e., the printed circuit board on which the patch antenna is mounted).

The air gap 500 is formed along the outer circumference of the lower dielectric layer 160 and is formed in a ring shape having a cross section in a predetermined shape. In this time, the cross section of the air gap 500 can be formed in various shapes according to a shape of the portion where the upper dielectric layer 140 and the lower dielectric layer 160 are bonded. For example, the cross section of the air gap 500 is formed in various shapes such as a square shape, a square shape having one side rounded, and a square shape having one side edge rounded.

The lower dielectric layer 160 is bonded to the lower surface of the upper dielectric layer 140. The lower dielectric layer 160 has the lower patch 300 bonded to the lower surface thereof. The lower dielectric layer 160 is formed in various shapes such as a square shape, a circular shape, and a square shape having at least one edge rounded. The lower dielectric layer 160 is formed to have a second area narrower than the upper dielectric layer 140.

In this time, the lower dielectric layer 160 can be formed with a feed hole 162 into which a feed pin for the feed of the radiation patch 200 is inserted.

The upper dielectric layer 140 and the lower dielectric layer 160 can be made of different materials to be bonded, or can be made of the same material to be bonded. In this time, the upper dielectric layer 140 and the lower dielectric layer 160 can be made of the same material to be integrally formed.

As described above, when the dielectric layer 100 is composed of the upper dielectric layer 140 and the lower dielectric layer 160 having areas different from each other and is mounted on the printed circuit board 400, the patch antenna can form the air gap 500 in a region between a part of the lower surface of the upper dielectric layer 140 and the outer circumference of the lower dielectric layer 160 and the printed circuit board 400, thus implementing lightweight while maximizing antenna performance. That is, the air gap 500 has low permittivity (about 1.03) and loss (i.e., Loss Tangent=0), such that the patch antenna can enhance antenna performance (i.e., gain), and can reduce the volume of the dielectric layer 100, thus implementing lightweight.

The radiation patch 200 is formed on the upper surface of the dielectric layer 100. That is, the radiation patch 200 is a thin plate of a conductive material having a high conductivity such as copper, aluminum, gold, and silver, and is formed on the upper surface of the dielectric layer 100. In this time, the radiation patch 200 is formed in a polygonal shape such as a square shape, a triangular shape, a circular shape, and an octagonal shape. The radiation patch 200 is connected to a feed point by coupling or is connected to a feed pin connected by penetrating the dielectric layer 100 to drive, and receives GPS signals, GNSS signals, and SDARS signals.

The lower patch 300 is formed on the lower surface of the dielectric layer 100. That is, the lower patch 300 is a thin plate of a conductive material having a high conductivity such as copper, aluminum, gold, and silver, and is formed on the lower surface of the dielectric layer 100. In this time, the lower patch 300 can be formed on the entire lower surface of the dielectric layer 100 because it is necessary to obtain a certain or more area in order to form a ground. The lower patch 300 can be also formed with a feed hole 320 into which a feed point or a feed pin is inserted.

FIGS. 12 and 13 illustrate the results measuring the antenna characteristics of the conventional patch antenna and the patch antenna according to an embodiment of the present disclosure, which have the same size (35×35, 5T) at the frequencies (i.e., 2320 MHz, 2326 MHz, 2332 MHz, 2338 MHz, 2345 MHz) included in the SDARS band.

Referring to FIG. 12, it can be seen that the patch antenna according to an embodiment of the present disclosure forms the air gap 500 with low loss, such that an average gain of the Left Hand Circular Polarization (LHCP) and an average gain of the Horizontal Polarization (HP) has increased by about 1 dB in the frequencies of the SDARS band as compared with the conventional patch antenna.

Referring to FIG. 13, it can be seen that the patch antenna according to an embodiment of the present disclosure forms the air gap 500 with low loss, such that a peak gain according to a change in an elevation, angle has increased by about 1 dBic according to the measured result as compared with the conventional patch antenna.

The patch antenna according to an embodiment of the present disclosure can increase the power density in the radio wave reception region as compared with the conventional patch antenna as the gain increases, thus improving the reception rate.

In addition, the patch antenna according to an embodiment of the present disclosure can form the air gap that is lighter than the materials used as the dielectric layer to reduce the weight, thus implementing lightweight.

As described above, although preferred embodiments of the present disclosure have been described, it is to be understood that they can be modified into various forms, and various modifications and changes thereof can be embodied by those skilled in the art to which the present disclosure pertains without departing from the scope of the present disclosure.

The invention claimed is:

1. A patch antenna mounted on a board, comprising:

a dielectric layer;

a radiation patch formed on the upper surface of the dielectric layer;

a lower patch formed on the lower surface of the dielectric layer; and an air gap formed in a region between the dielectric layer and the board, wherein the dielectric layer is formed so that an area of the upper surface is wider than an area of the lower surface, wherein the dielectric layer has a stepped portion formed along the outer circumference of the lower surface thereof, and wherein the air gap is formed in a region between the board and the stepped portion and the air gap is formed in a ring shape.

2. The patch antenna of claim 1, wherein the lower surface of the dielectric layer faces the board when the patch antenna is mounted on the board.

3. The patch antenna of claim 1, wherein the lower patch is formed on the entire lower surface of the dielectric layer.

4. The patch antenna of claim 1, wherein the air gap is formed in a shape surrounding the surroundings of the lower patch.

5. The patch antenna of claim 1, wherein a cross section of the air gap is formed in a square shape.

6. The patch antenna of claim 1, wherein the dielectric layer comprises an upper dielectric layer having the radiation patch formed on the upper surface thereof; and a lower dielectric layer located on the lower portion of the upper dielectric layer, and having the lower patch formed on the lower surface thereof, wherein the upper dielectric layer is formed to have a wider area than the lower dielectric layer.

7. The patch antenna of claim 6, wherein the upper dielectric layer has a part of the lower surface exposed toward the board.

8. The patch antenna of claim 6, wherein the air gap is formed in a region interposed between the lower surface of the upper dielectric layer and the outer circumference of the lower dielectric layer and the board.

9. The patch antenna of claim 8, wherein the ring shape has a cross section of a square shape.

10. The patch antenna of claim 6, wherein the upper dielectric layer and the lower dielectric layer are integrally formed.

* * * * *